United States Patent [19]

Reinehr et al.

[11] 4,138,461

[45] Feb. 6, 1979

[54] DRY SPINNING COARSE-DENIER ACRYLIC FIBRES

[75] Inventors: Ulrich Reinehr; Wolfhard Schmidt, both of Dormagen, Fed. Rep. of Germany

[73] Assignee: Bayer Aktiengesellschaft, Leverkusen, Fed. Rep. of Germany

[21] Appl. No.: 860,614

[22] Filed: Dec. 14, 1977

[30] Foreign Application Priority Data

Dec. 22, 1976 [DE] Fed. Rep. of Germany ..... 2658179

[51] Int. Cl.[2] ..... D01F 6/18

[52] U.S. Cl. ..... 264/206; 264/210 F

[58] Field of Search ..... 264/206, 210 F

[56] References Cited

FOREIGN PATENT DOCUMENTS

| | | | |
|---|---|---|---|
| 45-40700 | 12/1970 | Japan | 264/206 |
| 46-18811 | 5/1971 | Japan | 264/206 |
| 911341 | 11/1962 | United Kingdom | 264/206 |

*Primary Examiner*—Jay H. Woo

*Attorney, Agent, or Firm*—Plumley and Tyner

[57] ABSTRACT

The invention relates to dry-spun acrylic fibers and filaments having deniers of from 20 to 80 dtex and a strength of at least 1.5 cN/dtex; as well as to a process for their production.

4 Claims, 1 Drawing Figure

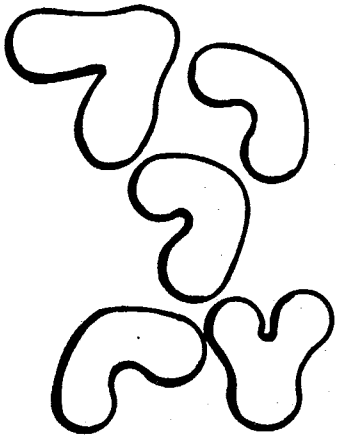

DRY SPINNING COARSE-DENIER ACRYLIC FIBRES

This invention relates to dry-spun coarse-denier fibres of polymers or copolymers of acrylonitrile and to a process for their production.

The production of coarse-denier fibres from polymers of acrylonitrile by wet-spinning is already known. For example, it is possible in accordance with German Offenlegungsschrift No. 2,434,488 to produce synthetic hair from spinnerets with 40 to 3000 spinning bores each having a diameter ranging from 200 to 500 μm with drafts of 0.8 to 3.

Unfortunately, it is not readily possible to produce acrylic fibres which have a denier of more than about 17 dtex and which still show an adequate strength of at least 1.5 centinewtons/dtex by the dry-spinning process. There are several reasons for this. The main difficulty is that the high spinning deniers of from 20 to 80 dtex are so heavy that they tend to break in the spinning duct. Another complicating factor is that the strength of these coarse-denier filaments in the duct is low on account of the relatively low rate of solvent evaporation, thereby promoting the breakage of filaments. In addition, the high solvent content of the filaments promotes their agglomeration in the duct. Accordingly, the throughput of spinning solvent cannot be arbitrarily increased in order to obtain coarse deniers.

Accordingly, dry-spun acrylic fibres in the denier range beyond 17 dtex which have a strength of at least 1.5 centinewtons/dtex have hitherto been unknown.

It has now been found that filaments or fibres with coarse deniers in the above-mentioned range can be produced by dry spinning providing the spinning bore diameter, the viscosity of the spinning solution, the temperature of the spinning solution, the extrusion rate, the draft and the thermal conditions prevailing in the spinning duct are carefully co-ordinated with one another.

Accordingly, the present invention provides a process for the production of acrylic filaments or fibres with deniers in the range of from 20 to 80 dtex by dry spinning, wherein a spinning solution having a temperature of at least 90° C. and a viscosity of at least 100 ball drop seconds at 90° C. is spun through spinnerets having bore diameters of from 0.4 to 0.8 mm, the spinning duct temperature amounting to at least 200° C. and the spinning gas temperature to at least 350° C., and the ratio of the extrusion rate S in m/min. to the spinning bore diameter in mm amounting to at most 100, and the ratio of the draft to the spinning bore diameter in mm amounting to at most 50. According to the invention, it is preferred to use acrylonitrile polymers having an acrylonitrile content of at least 85% by weight. The determination of viscosity in ball drop seconds is described by K. Jost, Rheoligica Acta, Vol. 1 (1958), page 303.

The spinning draft (V) is defined as the ratio between the take-off rate and the extrusion rate.

$$V = \frac{V\ \text{take-off}\ (m/\text{min.}^{-1})}{V\ \text{extrusion rate}\ (m/\text{min.}^{-1})}$$

The extrusion rate (S) is calculated as follows:

$$S = \frac{4 \times F\ (m/\text{min.}^{-1})}{Z\,d^2 \times 100}$$

where

R = throughput in ccm/min.

Z = number of spinning bores d = spinning bore diameter in cm.

The spinning solutions are usually prepared at 90° to 100° C., filtered and preferably delivered to the spinneret and spun at those temperatures. The duct temperatures are preferably in the range of from 210° to 235° C. and the air temperature in the spinning duct is preferably in the range of from 350° to 400° C.

No filaments can be spun from spinnerets with bore diameters of more than 0.8 mm because it is not possible in this case to obtain adequate solidification in the spinning duct. If, by contrast, the spinning bore diameter is in the range of from 0.4 to 0.8 mm, but with the ratio between draft and bore diameter greater than 50, it is again not possible to obtain solidification of the filaments.

If the ratio of extrusion rate to spinning bore diameter is greater than 100, too high a pressure builds up in the spinnerets and causes them to burst.

The filaments and fibres obtained by the process according to the invention surprisingly show a cross-sectional form differing from the dumbell form normally obtained in dry spinning. Web-shaped, horse-shoe-shaped, heart-shaped and trilobal fibre cross-sections are increasingly obtained with increasing denier above 20 dtex.

This is particularly advantageous because synthetic fibres with trilobal cross-sections are known to show the least soiling (A. Lehnen et al, Chemiefasern and Textilindustrie 1975, No. 3, pages 251–254). In addition, filaments and fibres produced in accordance with the invention have strengths of 1.5 cN (centinewtons)/dtex and higher.

Accordingly, the invention also provides dry-spun acrylic fibres and filaments having deniers of from 20 to 80 dtex and strengths of at least 1.5 cN/dtex.

Fibres such as these are particularly suitable for synthetic hairs, straight hairs for imitation furs and in the carpet sector.

The accompanying drawings shows the cross-sectional forms of Examples of the fibres produced in accordance with the invention.

EXAMPLE 1

An acrylonitrile copolymer of 93.6% of acrylonitrile, 5.7% of methyl acrylate and 0.7% of sodium methallyl sulphonate with a K-value of 81 was dissolved in dimethyl formamide at 90° C. The filtered spinning solution, which had a final concentration of about 33% by weight and a viscosity of 133 ball drop seconds at 90° C., was dry spun from a 72 bore spinneret having a spinning bore diameter of 0.4 mm. The duct temperature was 210° C. and the air temperature was 360° C. The take-off rate was 140 m/minute. The spinning solution was delivered from the spinning pump at a rate of 203 ccm/minute. The individual spun denier amounted to 67 dtex. The draft V amounted to 6.2 and the extrusion rate S to 22.6. This gives a ratio $Q_1$ of extrusion rate S (in m/minute) to bore diameter D (in mm) of 56.5 and a ratio $Q_2$ of draft to bore diameter of 15.5.

The filaments were wound into package form on bobbins, doubled to form a tow, drawn in a ratio of 1:2.5 in boiling water and after-treated in the usual way to form fibres with a final individual denier of 48 dtex. Fibre strength 1.5 centinewtons (dtex). Elongation at break 97%. The capillaries have horse-shoe-shaped to heart-shaped cross-sectional forms (cf. accompanying drawing which shows a photograph taken with a light microscope magnified 320 times).

Further examples of the production of coarse-denier fibres by the process according to the invention are summarised in Table I below. In every case, an acrylonitrile copolymer with the same chemical composition as in Example 1 was dissolved in DMF to form a spinning solution which was spun in the same way as described in that Example.

The duct temperature was 230° C. and the air temperature was 400° C. The filaments were again wound into package form on bobbins, doubled to form a tow, drawn in a ratio of 1:2.5 in boiling water and aftertreated in the usual way to form fibres with different final individual deniers. In every case, the fibres had a strength of about 1.7 centinewtons/dtex.

Table I

| No. | No. of spinning bores | Bore diameter (mm) | Take-off rate m/min. | Through-put (cc/min.) | Individual spun denier (dtex) | Final individual denier (dtex) | Extrusion rate (m/min.) | Draft (V) | $Q_1$ | $Q_2$ | Cross-section |
|---|---|---|---|---|---|---|---|---|---|---|---|
| 1 | 72 | 0.8 | 120 | 312 | 80 | 57 | 8.6 | 13.9 | 10.8 | 17.4 | horse-shoe |
| 2 | 72 | 0.8 | 200 | 312 | 67 | 48 | 8.6 | 23.2 | 10.8 | 29.0 | heart-shaped |
| 3 | 72 | 0.8 | 300 | 312 | 46 | 33 | 8.6 | 34.8 | 10.8 | 43.5 | " |
| 4 | 72 | 0.4 | 200 | 312 | 67 | 47 | 35.1 | 5.7 | 87.8 | 14.3 | " |
| 5 | 72 | 0.4 | 300 | 312 | 46 | 33 | 34.9 | 8.6 | 87.3 | 21.5 | " |

COMPARISON EXAMPLES

1. Part of the spinning solution of Example 1 was dissolved, filtered and spun in the same way as described in that Example, except that the duct temperature was only 180° C. The solution could not be solidified to form filaments.

2. An acrylonitrile copolymer having the same chemical composition and K-value as in Example 1 was dissolved in DMF at 90° C. The filtered spinning solution, which had a final concentration of 29.5% by weight and a viscosity of 87 ball drop seconds, was dry-spun from a 72-bore spinneret having a spinning bore diameter of 0.4 mm. The duct temperature was 170° C., the air temperature was 360° C. and the take-off rate was 200 m/minute. The spinning solution was delivered from the spinning pump at a rate of 157 cc/minute. It could not be solidified to form filaments because its viscosity was too low. Even an increase in the duct temperature to 220° C. did not produce any improvement.

3. Further spinning tests are summarised in Table II below. The same spinning solution as in Example 1 with the same concentration, spinning solution temperature, viscosity, duct and air temperature were used in every case, although in no case was it possible to obtain a solidified filament because not all the parameters according to the invention had been adhered to.

Table II

| No. | No. of spinning bores | Bore diameter (mm) | Take-off rate m/min. | Through-put (cc/min.) | Extrusion rate m/min. | Draft (V) | $Q_1$ | $Q_2$ |
|---|---|---|---|---|---|---|---|---|
| A | 72 | 0.8 | 400 | 312 | 8.6 | 46.4 | 58.0 | 58.0 |
| B | 36 | 1.5 | 200 | 133 | 2.1 | 96 | 1.4 | 64.0 |
| C | 96 | 0.25 | 120 | 212 | 44.4 | 2.7 | 177.6 | 10.8 |
| D | 72 | 0.4 | 250 | 390 | 43.1 | 5.8 | 107.8 | 14.5 |

What we claim is:

1. A process for the production of acrylic filaments or fibres having deniers of from 20 to 80 dtex and strengths of at least 1.5 cN/dtex, which comprises subjecting a spinning solution having a temperature of at last 90° C. and a viscosity of at least 100 ball drop seconds at 90° C. to dry spinning through spinnerets having a bore diameter of from 0.4 to 0.8 mm, the spinning duct temperature being at least 200° C. and the spinning gas temperature at least 350° C., the ratio of extrusion rate S in m/min. to the spinning bore diameter in mm amounting to at most 100, and the ratio of the draft to the spinning bore diameter in mm amounting to at most 50.

2. The process of claim 1, wherein the spinning solution has a temperature of from 90° to 100° C.

3. The process of claim 1, wherein the duct temperature is from 210° to 235° C.

4. The process of claim 1, wherein the spinning gas is air at a temperature of from 350° to 400° C.

* * * * *